United States Patent [19]

Nolan

[11] Patent Number: 4,869,491

[45] Date of Patent: Sep. 26, 1989

[54] EXERCISE DEVICE

[76] Inventor: Timothy J. Nolan, 3801 Jay, Rolling Meadows, Ill. 60008

[21] Appl. No.: 125,545

[22] Filed: Nov. 25, 1987

[51] Int. Cl.[4] ..... A63B 21/02; A63B 5/00

[52] U.S. Cl. ..... 272/67; 272/68; 272/140; 272/122

[58] Field of Search ..... 272/67, 68, 75, 140, 272/93, 142, 143, 901, 902, 126, 127, 132

[56] References Cited

U.S. PATENT DOCUMENTS

| | | | |
|---|---|---|---|
| 2,719,038 | 9/1955 | Massa | 272/75 |
| 2,806,699 | 9/1957 | Spooner | 272/83 |
| 3,396,967 | 8/1968 | Brown | 272/67 |
| 3,510,130 | 5/1970 | Ferdinand | 272/67 |
| 3,559,988 | 2/1971 | Greenless | 272/83 |
| 3,588,102 | 6/1971 | Gifford | 272/67 |
| 3,746,336 | 7/1973 | Tanimoto | 272/67 |
| 4,095,789 | 6/1978 | Mueller | 272/140 |
| 4,155,547 | 5/1979 | Savio et al. | 272/67 |
| 4,165,070 | 8/1979 | Rice | 272/122 |
| 4,203,591 | 5/1980 | Gibson | 272/67 |
| 4,249,729 | 2/1981 | Gabrielidis | 273/29 A |
| 4,557,479 | 12/1985 | Guibert | 272/122 |
| 4,591,151 | 5/1986 | Hensley | 272/68 |
| 4,770,409 | 9/1988 | Wallisch | 272/67 |

*Primary Examiner*—Richard J. Apley
*Assistant Examiner*—S. R. Crow
*Attorney, Agent, or Firm*—Fitch, Even, Tabin & Flannery

[57] ABSTRACT

An exercise device including a pair of nonaligned hand grips rotatably mounted on a nonlinear bar and spring biased to provide adjustable resistance to motion through predetermined symmetrical strokes. The device preferably includes detachable auxiliary weights which enable the total weight of the device to be adjusted. The spring biasing force applied to the grips is preferably individually adjustable for each grip.

13 Claims, 1 Drawing Sheet

FIG. 1
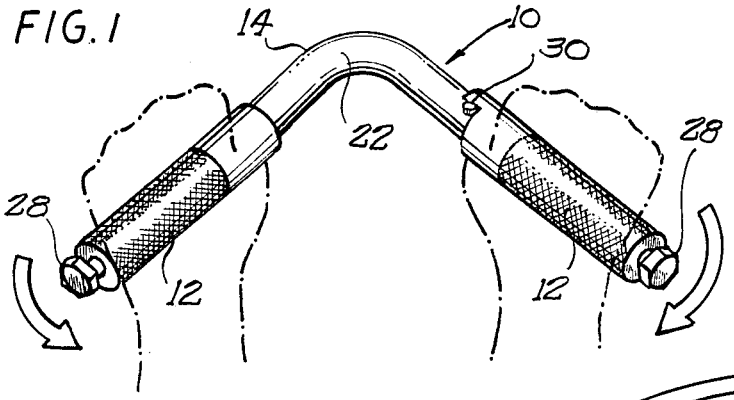
FIG. 2
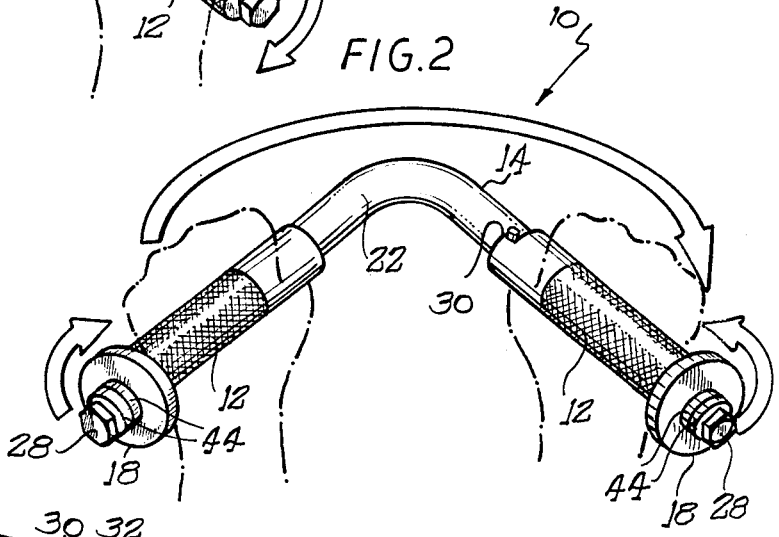
FIG. 3
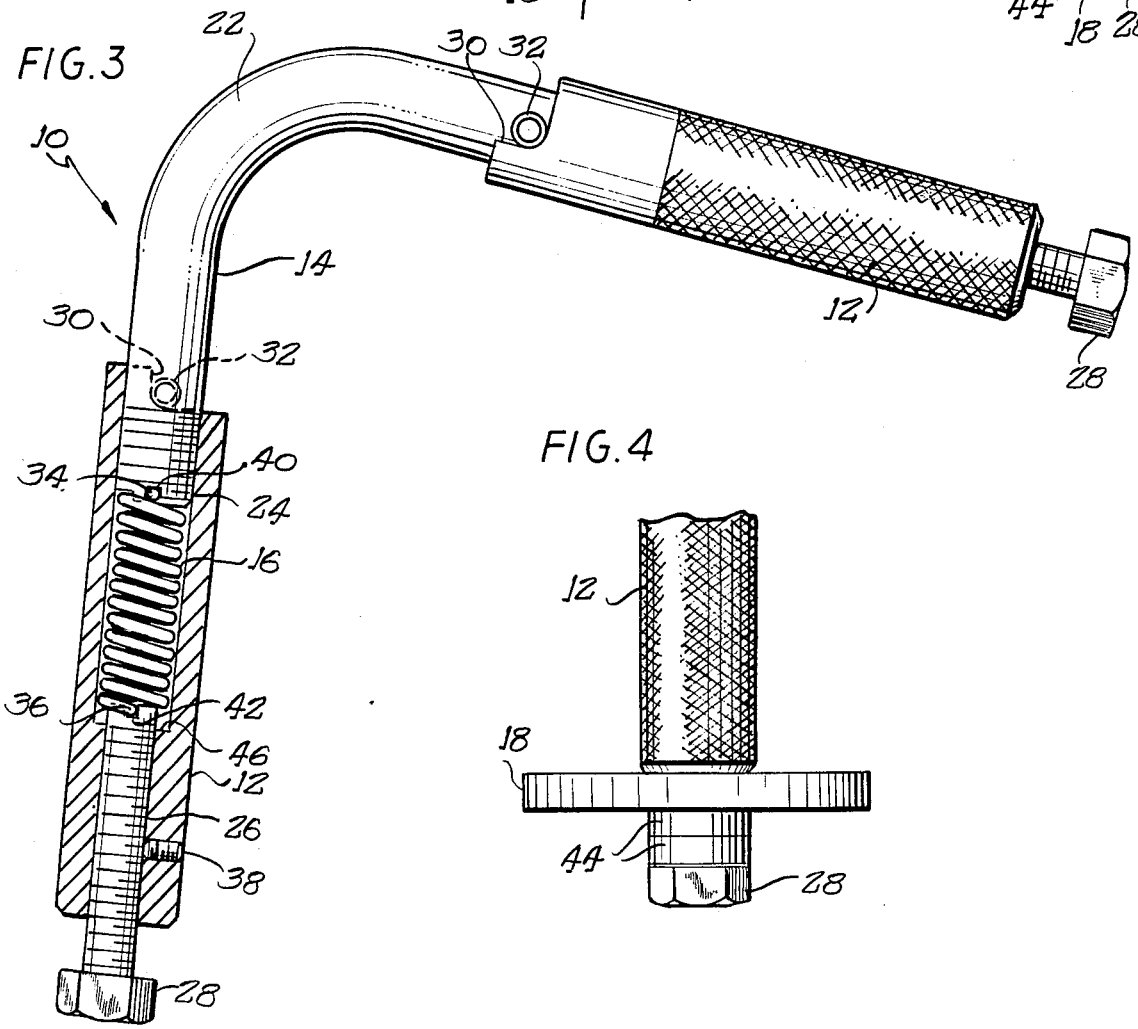
FIG. 4

EXERCISE DEVICE

BACKGROUND OF THE INVENTION

The invention relates generally to exercise devices, and more particularly to a device for use in an exercise where the user rotates a pair of grips.

One type of exercise device employs a friction clutch to resist rotation of hand grips. An example of such a device is described in U.S. Pat. No. 4,203,591.

Other exercise devices employ springs to provide relative resistance between a pair of axially aligned hand grips. An example of this type of device is described in U.S. Pat. No. 4,095,789.

One difference between the friction device and the spring-loaded device is that in the latter, the springs maintain torque in a predetermined direction on the grips through a predetermined range of motion, regardless of whether the grips are being rotated, whereas in the friction device, the friction clutch only applies torque to a grip during rotation of the grip, in a direction opposite to rotation of the grip. Thus, with the latter type of device, when the user rotates a grip in reciprocating motion, the muscles are able to apply force in a single rotational direction while moving alternately in opposite directions.

In devices having aligned rotatable grips, when the user applies torque to one of the grips, he or she must apply oppositely-directed torque of equal magnitude to the opposite grip in reaction thereto. The user accordingly cannot apply torque to either grip in excess of the torque he is capable of applying to the other grip in the opposite direction. The present invention pertains to a device which is not so limited, and which is believed to provide various other advantages over the prior art.

Accordingly, it is a general object of the present invention to provide an improved exercise device of the type having rotatable hand grips and means for providing resistance to rotation thereof.

It is an additional object of the present invention to provide an exercise device which is relatively economical to manufacture, relatively compact, and adjustable to permit variation of resistance to twisting of hand grips.

Further objects and advantages of the invention will become apparent from the detailed description set forth below, and the accompanying drawings.

SUMMARY OF THE INVENTION

In accordance with the invention, there is provided an exercise device including a pair of nonaligned hand grips which are rotatably mounted on a nonlinear bar and spring-biased to provide adjustable resistance to motion through predetermined symmetrical strokes. The device preferably includes detachable auxiliary weights which enable the total weight of the device to be adjusted. The spring biasing force applied to the grips is preferably individually adjustable for each grip. The orientation of the biasing means, enabling symmetrical rotation of the grips against spring torsion, enables the user to move both arms and hands in identical, symmetrical motion in an exercise, with either the same force resisting torsion of each grip, or a selected difference in the torsional resistance to rotation between the two grips. The springs are preferably coil springs which are disposed within the respective grips. The device is designed so as to be compact, relatively simple to manufacture, and relatively simple to adjust.

BRIEF DESCRIPTION OF THE DRAWINGS

FIG. 1 is a perspective view of an exercise device in accordance with the invention.

FIG. 2 is a perspective view of the device of FIG. 1, in combination with a pair of auxiliary weights.

FIG. 3 is a plan view of the device of FIG. 1, shown partially in section.

FIG. 4 is a fragmentary view of an end portion of the device of FIG. 1, shown in combination with an auxiliary weight.

DETAILED DESCRIPTION OF THE PREFERRED EMBODIMENTS

The invention is generally embodied in an exercise device 10 which comprises a pair of rotatable grips 12, disposed on opposite ends of a nonlinear bar 14. The bar 14 is preferably generally V-shaped. Each of the grips 12 has a limited range of rotational motion during use, and is biased for rotation in a predetermined direction relative to the bar 14.

In accordance with one feature of the invention, the grips 12 are biased for rotation by a pair of torsion springs 16 disposed internally of the grips to apply torque to the grips 12 such that the grips 12 may be reciprocated symmetrically with respect to one another, so that a user may exercise both arms in the same manner at the same time with the device 10. Thus, as illustrated in FIG. 1, the user may hold the grips and rotate both of his or her wrists outwardly together, opposed by the spring load, and at the end of the outward motion, the user may reduce the torque manually applied to the grips 12, and the springs 16 will return the grips to their initial positions.

In accordance with another feature of the invention, the user may, by rotating the device 10 180°, as indicated in FIG. 2, orient the device so that it is suitable for a second exercise in which the spring load opposes inward rotation of both of the grips 12.

In accordance with an additional feature of the invention, auxiliary weights 18 are provided which are attachable to the device adjacent the grips 12. It is intended that the device be used while held in front of the user, about chest high, and the additional weights 18 provide more strenuous exercise for various muscle groups, due to the added weight necessary to maintain the device in position during the rotation of the grips 12. The illustrated weights 18 are relatively small, and in other embodiments of the invention larger, heavier weights than those illustrated herein may be used.

In accordance with a further feature of the invention, the biasing force is independently adjustable for each grip 12. This enables the user to make rotation of one grip more difficult than the other if desired, as well as enabling the user to increase or decrease the spring load on both grips in a like manner.

Turning to a more detailed description of the preferred embodiment of the invention, the bar 14 preferably has a pair of substantially linear, threaded end portions 20 joined by a curved central portion 22. In the illustrated embodiment, the bar 14 defines an included angle of about 80°, and is coplanar.

The grips 12 are preferably tubular sleeves, each having an internally-threaded bore. In the illustrated embodiment, the bore is stepped, including a first threaded portion 24 of relatively large diameter for receiving an end portion 20 of the bar 14, and a second threaded portion 26 of smaller diameter for receiving an adjustment bolt 28.

Each of the grips 12 has a pair of shoulders 30 defined thereon for engaging a stop 32 on the bar 14. The stop 32 on the bar is preferably a screw or bolt. When the device is not in use, the shoulders 30 are biased against the grips by the springs 16. The stops 32 cooperate with the shoulders 30 to define a predetermined range of motion for each of the grips 12. In the illustrated embodiment, the shoulders 30 on each grip are about 180° apart, to provide a range of motion of about 180°. The exterior surfaces of the grips 12 are preferably knurled over a portion of their length to aid in gripping by the user's hands.

The coil spring 16 for each grip 12 is disposed within the large-diameter portion 24 of the bore of the grip 12, having its inner end 34 connected to the bar 14 and the opposite end 36 connected to the adjustment bolt 28. The bar 14 has a transverse slot 40 at each end to receive the inner ends 34 of the respective springs 16, and each of the adjustment bolts 28 similarly has a transverse slot 42 at its inner end to receive the outer end 36 of its associated spring 16. The adjustment bolt 28 is kept immovable relative to the grip by a set screw 38 during use of the device.

The threads of the small-diameter portion 28 of the bores of the grips 12 are of opposite hand, as are the threads of the two adjustment bolts 28. This enables the respective springs 16 to be preloaded in opposite directions by tightening of adjustment bolts 28, to provide for opposite-handed torsional spring-loading for the respective grips. Except for the difference in the thread orientation, the grips 12 are identical to one another.

The auxiliary weights 18 are preferably relatively flat disks, each having a central bore for the shaft of an adjustment bolt 28 to pass through. In FIG. 2, the device 10 is illustrated with two auxiliary weights 18 attached thereto, one associated with each of the grips 12. Additional weights 18 may be installed, and annular spacers 44 are provided to stabilize the weights. The spacers 44 are disposed on each adjustment bolt 28, between the head of the bolt and the weight or weights 18 mounted thereon.

To assemble the device 10, the first step is to insert the inner ends 34 of the springs into the slots 40 in the ends of the bar 14, and to screw the grips 12 onto the bar 14 to a position where the shoulders 30 are disposed at the proper axial locations for engagement with the stops 32. The stops 32 are then inserted into transverse threaded bores in the bar 14.

Once the grips 12 are in place, the adjustment bolts 28 are screwed into the smaller bores 26 one at a time. When the leading end of an adjustment bolt 28 reaches the larger bore 24 of its associated grip 12, the groove 42 in the leading end of the bolt 28 engages the adjacent end 36 of the torsion spring 16. As the bolt rotates, groove 42 becomes aligned with the end 36 of the spring and receives the end 36. The spring 16 is compressed longitudinally, and the resilience of the spring locks the spring end 36 in the groove 42 so that subsequent rotation of the bolt 28 stresses the spring 16 torsionally. When the desired torsion is reached, the set screw 38 is tightened to lock the bolt 28 in place.

One advantage of the stepped bore in the grip 12 is that it facilitates removal of the adjustment bolt 28 from the grip 12, which is necessary in order to add or remove weights 18. The spring 16 is sized so that its diameter does not permit it to enter the smaller bore 26. As the end of the bolt 28 is withdrawn from the larger bore 24, the outer end 36 of the spring 16 abuts the annular surface which surrounds the entrance to the smaller bore 26, facilitating disengagement of the spring from the bolt 28.

An advantage of the provision of detachable auxiliary weights, as described above, is that the device can be used to exercise muscles of the upper arms and shoulders by virtue of the function of these muscles in supporting the weight of the device, at the same time the muscles of the wrists and forearms are being exercised by performance of a twisting motion. In the past, devices of this type have frequently been of negligible weight, or at least of fixed, relatively light weight, and have been therefore devoted entirely to wrist exercise. The present invention not only enables additional exercise benefit, but permits the total weight of the device to be adjusted to provide the maximum benefit for each particular user.

The action of the stops as described above also provides a advantage for the device 10, as compared with devices wherein the user works against a spring which is relaxed when the device is at rest. With such prior art devices, the device offers essentially no resistance at the beginning of each stroke. By contrast, with the above-described device 10, the grips are subjected to a torsional preload against the stops, so that the user encounters torsional resistance through the entire stroke of each grip.

From the foregoing, it should be apparent that the invention provides a novel exercise device which provides variable resistance to twisting of a pair of rotatable grips, has a variable weight, and is compact and easily assembled. The invention is not limited to the embodiments described above, or to any particular embodiment, but is defined by the following claims.

What is claimed is:

1. An exercise device comprising:

a nonlinear bar which includes first and second substantially linear end portions;

first and second rotatable grips, the first rotatable grip being disposed coaxially of the first linear end portion of the bar, the second rotatable grip being disposed coaxially of the second linear end portion of the bar, both grips being rotatable with respect to the bar;

biasing means applying torque to the grips, which biasing means is a pair of opposite-handed torsional coil springs, each being disposed within a respective one of said grips for torsion loading said grips in opposite directions;

stop means associated with each of the grips defining a limited range of motion for each of the grips relative to their respective end portions of the bar; and adjustment means for varying the torque applied by the biasing means;

the biasing means being oriented so that the torque is applied to the respective grips symmetrically to rotate both wrists in the same direction;

whereby a user may provide equivalent exercise for both arms simultaneously.

2. An exercise device in accordance with claim 1 wherein each of said coil springs has a first end affixed to said bar and an opposite end fixed relative to its associated grip.

3. An exercise device in accordance with claim 1 wherein said stop means comprises a pair of removable fasteners attached to said bar, one adjacent each of said grips, and means on each of said grips for engaging said removable fasteners.

4. An exercise device in accordance with claim 1 wherein said adjustment means comprises a pair of bolts, one extending longitudinally within each of said grips, each of said springs having one end attached to said bolt for rotation therewith.

5. An exercise device in accordance with claim 4 wherein said adjustment means further comprise a pair of set screws, one associated with each grip, for selectively locking said bolts in place in predetermined positions relative to the respective grips.

6. An exercise device in accordance with claim 1 further comprising a plurality of removable weights.

7. An exercise device in accordance with claim 6 wherein the stop means comprises at least one shoulder on each grip and a pair of screws, one associated with each of said grips, each screw being insertable into a threaded bore in the bar and positionable for engagement with a shoulder on a respective one of the grips.

8. An exercise device comprising:

a nonlinear bar which includes first and second substantially linear end portions;

first and second rotatable grips, the first rotatable grip being disposed coaxially of the first linear end portion of the bar, the second rotatable grip being disposed coaxially of the second linear end portion of the bar, both grips being rotatable with respect to the bar;

first biasing means applying torque to said first grip, which first biasing means is a torsional spring operable to have its torque load increased by one of a clockwise and counterclockwise rotation of said first grip about said bar;

second biasing means applying torque to said second grip independently of said first biasing means, which second biasing means is a torsional spring operable to have its torque load increased by the same one of a clockwise and counterclockwise rotation of said second grip about said bar said first and second biasing means being loaded in opposite directions;

stop means associated with each of the grips defining a limited range of motion for each of the grips relative to their respective end portions of the bar; and adjustment means for independently varying the torque applied by the first and second biasing means respectively;

the biasing means being oriented so the torque is applied to the respective grips symmetrically.

9. An exercise device in accordance with claim 8 wherein each of the grips has an internal stepped bore that has a first portion of relatively large diameter for receiving one of the substantially linear end portions of the bar, and a second portion of smaller diameter contiguous and axially aligned therewith;

the first and second torsional springs, one disposed within each of the grips, located in the first, relatively large diameter portion of the internal bore thereof;

each of the springs being a coil spring having a diameter greater than the diameter of the second portion of the bore;

the adjustment means including a pair of bolts, one engaging the second portion of the bore of each of the grips, and a pair of set screws for locking the bolts in predetermined positions relative to the grips.

10. An exercise device in accordance with claim 9 wherein each of the bolts is in threaded engagement with the first portion of its associated bore.

11. An exercise device in accordance with claim 10 wherein each said bolt has a transversely grooved inner end for engaging a respective one of said springs.

12. A method of operating an exercise device having a pair of nonaligned, rotatable, torsionally-biased grips disposed at opposite ends of a rigid bar, comprising the steps of:

placing one's hands on said grips;

rotating the grips simultaneously in a first exercise wherein the grips are first rotated outwardly against the torsional bias, then rotated back inwardly in the same direction as the torsional bias;

rotating the device 180° to reverse the grips; and rotating the grips simultaneously in a second exercise wherein the grips are first rotated inwardly against the torsional bias, then rotated back outward in the same direction as the torsional bias;

the grips being moved simultaneously in opposite directions relative to the respective ends of the bar in each exercise, so that the user's hands and wrists are moved in symmetrical motion relative to one another in each exercise.

13. An exercise device for developing arm muscles, said device comprising:

a nonlinear member having a central section and two symmetrical free end sections extending angularly and at equal angles from the central section;

a rotatable grip on each free end section mounted for turning movement on each end section; and biasing means, which biasing means is a pair of opposite handed torsional coil springs each being disposed within a respective one of said grips, providing a resistance force against turning of the user's arms and wrists in a first common directional movement when the central section is in a first position;

said biasing means providing a resistance force against turning of the user's arms and wrists in a second common opposite directional movement when the central section has been turned through 180° from the first position.

* * * * *

UNITED STATES PATENT AND TRADEMARK OFFICE

CERTIFICATE OF CORRECTION

PATENT NO. : 4,869,491

DATED : September 26, 1989

INVENTOR(S) : Timothy J. Nolan

It is certified that error appears in the above-identified patent and that said Letters Patent is hereby corrected as shown below:

Column 4, Line 22, Change "a" to --an--.

Column 5, Line 44, after "bar" insert a comma.

Column 5, Line 54, change "the" (second occurrence) to --that--.

Column 6, Lines 47-48, change "opposite handed" to --opposite-handed--.

Signed and Sealed this

Ninth Day of October, 1990

*Attest:*

HARRY F. MANBECK, JR.

*Attesting Officer*

*Commissioner of Patents and Trademarks*